US006870105B2

(12) United States Patent
Maydanich et al.

(10) Patent No.: US 6,870,105 B2
(45) Date of Patent: Mar. 22, 2005

(54) HIGH DENSITY ELECTRICAL INTERCONNECT SYSTEM FOR PHOTON EMISSION TOMOGRAPHY SCANNER

(75) Inventors: Fyodor I. Maydanich, Wauwatosa, WI (US); James Malaney, Powauken, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/757,881

(22) Filed: Jan. 15, 2004

(65) Prior Publication Data

US 2004/0144560 A1 Jul. 29, 2004

Related U.S. Application Data

(62) Division of application No. 09/993,424, filed on Nov. 16, 2001, now Pat. No. 6,744,051.

(51) Int. Cl.[7] ..... H01B 11/06
(52) U.S. Cl. ..... 174/72 TR; 174/117 F
(58) Field of Search ..... 174/36, 72 TR, 174/117 F

(56) References Cited

U.S. PATENT DOCUMENTS

| | | | | |
|---|---|---|---|---|
| 3,757,029 A | * | 9/1973 | Marshall | 174/36 |
| 4,281,211 A | | 7/1981 | Tatum et al. | |
| 4,327,246 A | * | 4/1982 | Kincaid | 174/36 |
| 4,383,725 A | * | 5/1983 | Bogese et al. | 174/117 F |
| 4,404,424 A | * | 9/1983 | King et al. | 174/117 F |
| 4,409,427 A | * | 10/1983 | Plummer, III | 174/36 |
| 4,461,076 A | | 7/1984 | Plummer, III | |
| 4,818,820 A | * | 4/1989 | LaRock | 174/36 |
| 4,835,394 A | * | 5/1989 | Steele | 174/36 |
| 4,973,794 A | * | 11/1990 | Steele | 174/36 |
| 5,360,944 A | * | 11/1994 | Springer et al. | 174/117 F |
| 5,387,113 A | * | 2/1995 | Dickerson et al. | 174/36 |
| 5,393,928 A | | 2/1995 | Cribb et al. | |
| 5,428,187 A | * | 6/1995 | Crane et al. | 174/36 |
| 5,900,588 A | | 5/1999 | Springer et al. | |
| 6,235,993 B1 | | 5/2001 | Johnston et al. | |
| 6,285,028 B1 | | 9/2001 | Yamakawa | |
| 2002/0189847 A1 | | 12/2002 | Sakurai et al. | |

* cited by examiner

*Primary Examiner*—Dean A. Reichard
*Assistant Examiner*—Adolfo Nino
(74) *Attorney, Agent, or Firm*—Quarles & Brady LLP

(57) ABSTRACT

A high density of electrical interconnection together with well controlled electrical transmission characteristics, low emissivity from the cable and low susceptibility to external electromagnetic interference are obtained in a PET machine with an interconnection harness formed of a ribbon cable with an inner and outer shield. The inner shield together with alternate conductors of the ribbon cable provide a signal return and the outer shield provides an earth ground reducing the susceptibility of the conductors to external electrical noise and reducing emissions from the cable.

12 Claims, 1 Drawing Sheet

HIGH DENSITY ELECTRICAL INTERCONNECT SYSTEM FOR PHOTON EMISSION TOMOGRAPHY SCANNER

CROSS-REFERENCE TO RELATED APPLICATIONS

This application is a divisional application of Ser. No. 09/993,424 filed Nov. 16, 2001 now U.S. Pat. No. 6,744,051 entitled "High Density Electrical Interconnect System for Photon Emission Tomography Scanner" and claims the benefit thereof.

STATEMENT REGARDING FEDERALLY SPONSORED RESEARCH OR DEVELOPMENT

—

BACKGROUND OF THE INVENTION

The field of the invention is photon emission tomography scanners and in particular, a high density electrical interconnect system suitable for use with the many closely spaced detectors of such scanners.

Positrons are positively charged electrons that are emitted by radionucleotides which have been prepared using a cyclotron or other device. The radionucleotides most often employed in diagnostic imaging are fluorine-18 ($^{18}F$), carbon-11 ($^{11}C$), nitrogen 13 ($^{13}N$), and oxygen 15 ($^{15}O$). Radionucleotides are employed as radioactive tracers called "radiopharmaceuticals" by incorporating them into substances such as glucose or carbon dioxide. One common use for radiopharmaceuticals is in the medical imaging field.

Radiopharmaceuticals may be used in imaging by injecting the radiopharmaceutical into a patient where it accumulates in an organ of interest. It is known that certain specific radiopharmaceuticals become concentrated within or are excluded from certain organs. As the radiopharmaceutical becomes concentrated within the organ of interest, and as the radionucleotides decays and emits positrons, the positrons travel a very short distance before they encounter an electron upon which the positron is annihilated and converted into two photons or gamma rays.

This annihilation event is characterized by two features which are pertinent to medical imaging and particularly to medical imaging using photon emission tomography (PET). First, each gamma ray has an energy of essentially 511 keV upon annihilation. Second, the two gamma rays are directed in substantially opposite directions. If the general location of the annihilation can be identified in three dimensions, the shape of the organ of interest can be reconstructed for observation.

To detect annihilation locations, the PET scanner includes a plurality of detector units each connected to a detector module communicating with a central processor having coincidence detection circuitry. An example detector unit may include an array of crystals (e.g., 36) and a plurality of photo multiplier tubes (PMTs). The crystal array is located adjacent to the PMT detecting surface. When a photon strikes a crystal, the crystal generates light which is detected by the PMTs. At the detector modules, the signal intensities from the PMTs are combined and compared to a threshold (e.g., 100 keV). When the combined signal is above the threshold, an event detection pulse (EDP) is generated and communicated from the detector module to the processor.

The processor identifies simultaneous EDP pairs which correspond to crystals which are generally on opposite sides of the imaging area. Thus, a simultaneous pulse pair indicates that an annihilation has occurred on a straight line between an associated pair of crystals. Over an acquisition period of a few minutes, millions of annihilations are recorded, each annihilation associated with a unique crystal pair. After an acquisition period, recorded annihilation data is used by any of several different well-known procedures to construct a three-dimensional image of the organ of interest.

The determination of the coincidence by the processor, and thus the ability to generate an image, requires that the EDP signals be communicated with minimal distortion from the detector modules to the processor. This is necessary so that the time and energy level of the EDPs may be accurately determined. This in turn requires that the interconnections between the detector modules and the processor have a well-defined impedance, low signal cross-talk and low signal attenuation. These characteristics may be met by coaxial cable. Unfortunately, the large number of signals that must be communicated in a PET scanner from multiple detector units to the processor, makes the use of standard coaxial cable prohibitively expensive and impractically bulky.

Near coaxial cable performance can be obtained from a type of specially configured shielded ribbon cable in which many parallel conductors are joined together in a ribbon by a common insulating material. The ribbon is then covered by a conductive foil shield. By connecting the foil shield and every other conductor within the ribbon cable to a return potential, the signal carrying conductors are effectively surrounded by separate shields, much like the shielding of a coaxial cable. The balancing of the signals and current return reduces the emissions of the cable and the ribbon configuration allows convenient, high-density termination of the cable using multi-pin connectors and the like. Shielded ribbon cables of this type are commercially available from the 3M Company of Minnesota under the name "low skew pleated foil cable" (PFC).

This pleated foil cable, while providing the necessary controlled transmission characteristics, is substantially more susceptible to external electromagnetic interference and thus has proven unsuitable for use in PET scanners. While the inventors do not wish to be bound by a particular theory, this susceptibility problem may be because flat ribbon cable presents a larger open loop area, especially in less than ideal grounding configurations.

SUMMARY OF THE INVENTION

The present invention provides a second, outer shield layer around the shielded pleated foil cable. This second shield may be connected to an earth ground separate from the signal return to significantly reduce the susceptibility of such cable to EMI noise. The combination of the two shields and the flat ribbon form provides the transmission characteristics needed for PET scanners, together with low emissivity and low susceptibility, and allow high connection densities.

While the cable was developed specifically to meet the exacting demands of PET scanning, it is believed the invention has application in a variety of other equipment where similar requirements must be satisfied.

DETAILED DESCRIPTION OF THE PREFERRED EMBODIMENT

Figure 1:
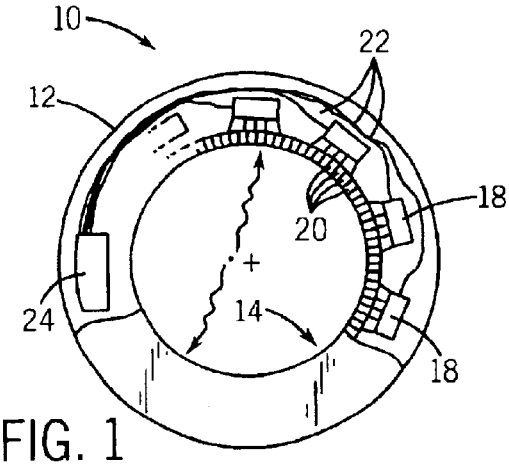
FIG. 1 is a simplified front elevational view of a PET scanner showing the collection of signals from detector units by detector modules for communication over interconnect harnesses to a processor module.

Referring now to FIG. 1, a PET scanner 10 may include a gantry ring 12 having a bore 14 for receiving a patient. The inner edge of the bore 14 is lined with detector units 20 for receiving gamma rays as known in the prior art.

A typical gantry ring may support several hundred separate detector units 20. Not shown, but as is understood in the art, each detector unit 20 may include a set of crystals arranged in front of a matrix of photo multiplier tubes. When a photon from the bore 14 strikes a crystal, a scintillation event occurs and the crystal generates light which is directed at the photo multiplier tubes. The photomultiplier tubes produce an analog signal which rises sharply when the scintillation event occurs, then tails off exponentially with a time constant of approximately 300 nanoseconds or less.

The signals from the detector units 20 are collected by detector modules 18 which provide event detection pulse (EDP) signals having similar characteristics over interconnect harnesses 22 with processor 24.

The processor 24 determines the energy of the detected event. If the energy detected is likely a photon, the actual coordinates of the detected event are determined from the known location of the detector units 20 and the signal from the event is time stamped. The time stamped events are compared with similar events from other detector units 20 to form coincidence pairs of events which are stored by the processor 24.

Figure 2:
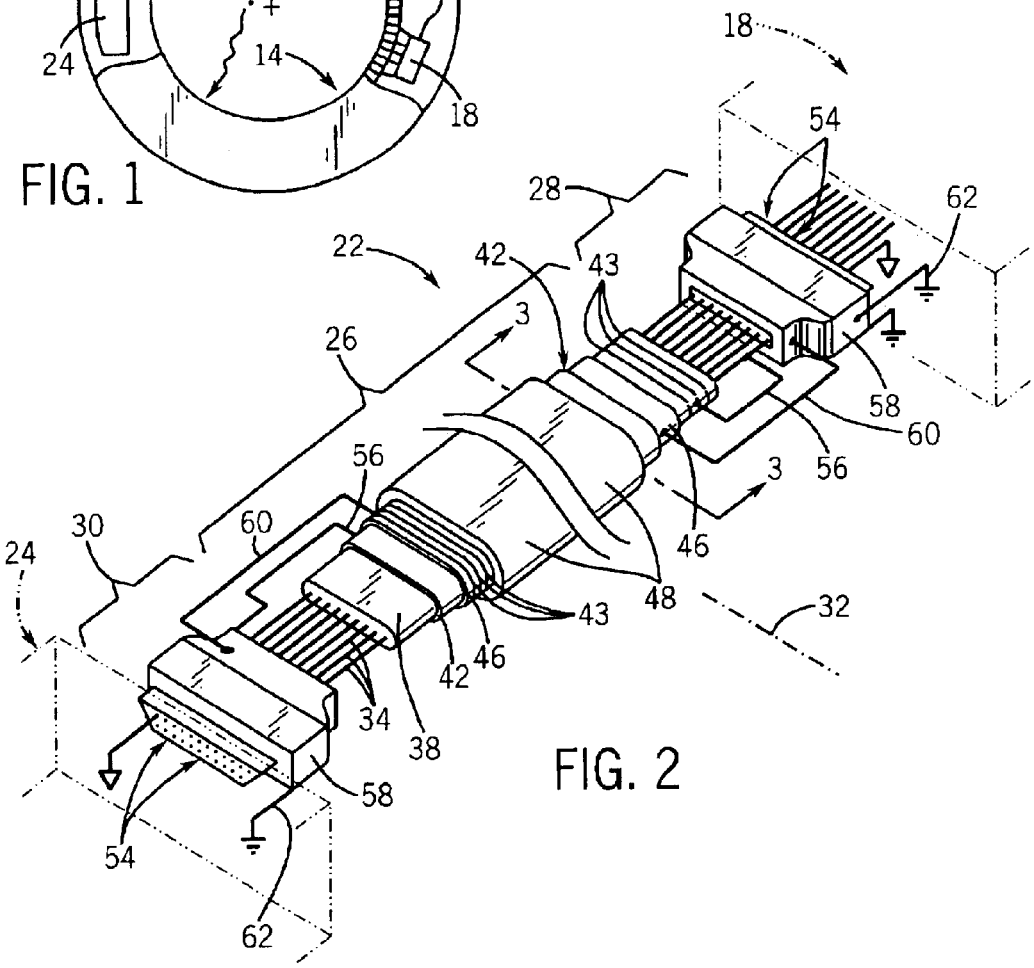
FIG. 2 is an exploded perspective view of one interconnection harness of FIG. 1 showing the use of a doubly shielded flat ribbon cable connected to terminating connectors.

Referring now to FIG. 2, the interconnect harnesses 22 must provide a separate signal lines for each detector unit and must provide electrical characteristics that do not substantially distort the EDP signals in a manner that would render their time of occurrence and energy inaccurately.

To this end, each interconnect harness 22 provides a flexible cable portion 26 terminated by a first and second connector 28 and 30, the former which may connect with a corresponding connector on the detector modules 18 and, the latter which may connect to a corresponding connector on the processor 24. The cable portion 26 is generally flat in cross section to be curved about a ribbon axis generally parallel to the flat surface of the cable portion 26 to be able to follow the curvature of the gantry ring 12.

Figure 3:
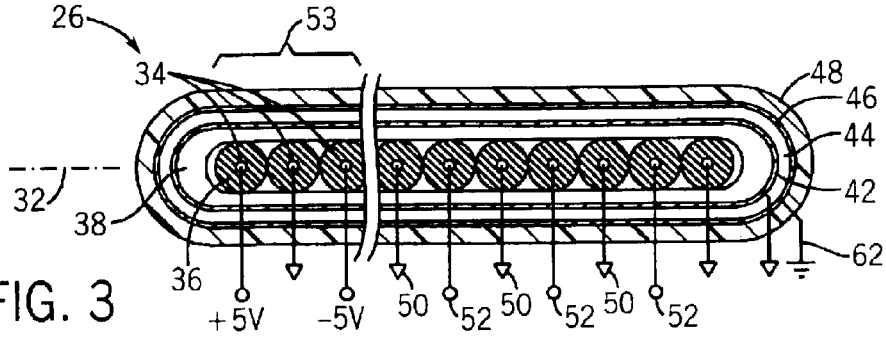
FIG. 3 is a cross-sectional view of the interconnection harness of FIG. 2 taken along line 3—3 of FIG. 2, showing the layered construction of the doubly shielded flat ribbon cable.

Referring still to FIGS. 2 and 3, the cable portion 26 includes a series of parallel conductors 34 having outer insulation 36. The conductors are separated from each other but held in a ribbon form by their insulation 36. The insulation 36 may be in one embodiment a thermoplastic elastomer and the conductors 34 30-gauge tinned solid copper spaced on a 0.025-inch pitch. The number of conductors 34 may vary between 20 and 100 depending on the application.

Surrounding the ribbon formed of insulators 36 and conductors 34, without disturbing the flat extent of the ribbon along the ribbon axis 32, is an optional paper insulator 38 which in turn may be surrounded by an inner conductive shield 42. The inner conductive shield 42 may be an adhesive backed pleated copper foil, the pleats 43 allowing expansion of the foils shield by unrolling of its pleats 43 as the cable portion 26 is curved about the ribbon axis. Ribbon cable with such a shield structure, using a 0.001 inch thick pleated copper foil as the shield, may be purchased from the 3M Corporation of Minnesota under the designator Low Skew Pleated Foil Cable (PFC) and is described in U.S. Pat. No. 5,900,588 hereby incorporated by reference. This cable provides approximately 50-ohm impedance with the connections described below and may serve as a basis for the present invention.

The invention adds an insulator, which may be a second paper layer 44 around the inner conductive shield 42 and an outer conductive shield 46 to surround that paper layer 44. The outer conductive shield 46 may also be a pleated copper foil like inner conductive shield 42.

An insulating and abrasion resistant jacket 48 such as a 0.026-inch layer of PVC covers the outer conductive shield 46.

Referring to FIG. 3, every other conductor 34 of the cable portion 26 may be connected to a signal return 50 designated by a downwardly pointing triangle. The remaining conductors, designated by circles, are used for power or data signals (e.g., EDP signals) and are collectively designated "harness signals" 52.

The inner conductive shield 42 may also be connected by a signal return 50 and in this way, the conductors 34 having harness signals 52, are surrounded on four sides by either conductors 34 or the inner conductive shield 42 carrying the signal return 50. By properly controlling the dielectric between the conductors 34 and the inner conductive shield 42 and their separation, the transmission line qualities of the cable portion 26 maybe controlled to reduce distortion in the transmitted signal.

The alternating conductors 34 carrying the signal return 50, as positioned between the conductors 34 carrying the harness signals 52, also reduces cross talk that may occur between the conductors 34 carrying the harness signals 52.

Two of the conductors 34 optionally also separated by a conductor 34 carrying the signal return 50 may be used to provide power from the processor 24 to the detector modules 18, those two conductors being at a first side 53 of the ribbon of conductors 34.

The outer conductive shield is connected to an earth ground being electrically independent from the signal returns 50 over the length of the interconnect harness 22.

Referring again to FIG. 2, the individual conductors 34 are connected to corresponding electrical connector elements 54 (e.g., pins or sockets) of electrical connectors 28 and 30. The electrical connectors 28 and 30 provide a high density, simple and releasable connection of the harness signals 52 and signal returns 50 between corresponding terminals of the detector units 20 and associated circuitry in processor 24.

The inner conductive shield 42 is also connected to one of the connector elements 54 to be easily accessible as indicated by path 56. The outer conductive shield 46, however, is connected to conductive shells 58 forming the outer housing of the connectors 28 and 30 as indicated by path 60. The paths 56 and 60 are expanded laterally for clarity only and may be realized through direct engagement between conductors supported by the connectors 28 and 30 and the inner conductive shield 42 and outer conductive shield 46 which may be trimmed to reveal their conductive surfaces prior to assembly with the connectors 28 and 30.

The earth ground 62 typically passes from a conductive housing of the processor 24 directly to the conductive shell 58 of connector 30 through outer conductive shield 46. From there it passes to the conductive shell 58 of connector 28 and then to a conductive housing of a detector module 18 to provide a gapless shielding of the harness signals 52 and signal returns 50.

It is specifically intended that the present invention not be limited to the embodiments and illustrations contained herein, but that modified forms of those embodiments including portions of the embodiments and combinations of elements of different embodiments also be included as come within the scope of the following claims.

We claim:

1. An electrical cable comprising:

a flexible ribbon consisting solely of a plurality of non-coaxial parallel electrical conductors embedded in an insulating material for insulating each of the plurality of electrical conductors from the others of the plurality of electrical conductors;

a first conforming flexible electrical shield covering the ribbon;

a flexible insulating layer covering the first conforming flexible electrical shield; and a second conforming flexible electrical shield covering the insulating layer.

2. The electrical cable of claim 1 including further an outer insulating jacket covering the second conforming electrical shield.

3. The electrical cable of claim 1 wherein the first and second conforming flexible electrical shields are metal foil.

4. The electrical cable of claim 3 wherein the first and second conforming flexible electrical shields are pleated.

5. The electrical cable of claim 1 further including at least one connector providing, within a connector shell, a plurality of releasable connector elements for electrically and mechanically engaging with corresponding elements in a second connector, the connector elements connected to the electrical conductors of the cable.

6. The electrical cable of claim 5 wherein the connector shell is electrically connected to the second conforming flexible electrical shield and the first conforming conductive electrical shield is connected to one of the connector elements.

7. A cable assembly providing electrical communication of a series of signals from a first electrical device to a second electrical device comprising:

a series of first terminals associated with the first electrical device including multiple signal terminals and at least one signal return terminal and at least one earth ground separate from the signal return terminal;

a series of second terminals associated with the second electrical device including multiple signal terminals and at least one signal return terminal;

a flexible ribbon consisting solely of a plurality of non-coaxial parallel electrical conductors embedded in an insulating material, wherein the conductors are mutually insulated and are attached to the terminals so that electrical conductors carrying signal returns alternate with conductors carrying signals;

a first conforming flexible electrical shield covering the ribbon and attached to a signal return terminal;

an insulating layer covering the outside of the first conforming flexible electrical shield; and a second conforming flexible electrical shield covering the insulating layer and attached to the earth ground.

8. The cable assembly of claim 7 wherein the cable further includes an outer insulating jacket covering the second conforming electrical shield.

9. The cable assembly of claim 7 wherein the first and second conforming flexible electrical shields are metal foil.

10. The cable assembly of claim 9 wherein the first and second conforming flexible electrical shields are pleated.

11. The cable assembly of claim 7 wherein the terminals are a plurality of releasable connector elements within a connector shell for electrically and mechanically engaging with corresponding elements in a second connector, the connector elements connected to ones of the electrical conductors of the cable and the connector shell electrically connected to the second conforming flexible electrical shield and the first conforming conductive electrical shield connected to one of the connector elements.

12. An electrical cable comprising:

a series of mutually insulated and parallel electrical conductors joined edgewise to form a flexible ribbon;

a first conforming flexible electrical shield comprising a pleated metal foil covering the ribbon;

a flexible insulating layer covering the first conforming flexible electrical shield; and a second conforming flexible electrical shield comprising a pleated metal foil covering the insulating layer.

* * * * *